US005619008A

United States Patent [19]

Chawla et al.

[11] Patent Number: 5,619,008

[45] Date of Patent: Apr. 8, 1997

[54] HIGH DENSITY PERFORATING SYSTEM

[75] Inventors: Manmohan S. Chawla, Houston; James W. Reese, Sugar Land, both of Tex.

[73] Assignee: Western Atlas International, Inc., Houston, Tex.

[21] Appl. No.: 613,065

[22] Filed: Mar. 8, 1996

[51] Int. Cl.[6] ..... F42B 1/02; F42D 3/00

[52] U.S. Cl. ..... 102/310; 102/307; 102/312; 102/313; 102/476

[58] Field of Search ..... 102/307, 309, 102/310, 312, 313, 476

[56] References Cited

U.S. PATENT DOCUMENTS

| | | | |
|---|---|---|---|
| 2,833,213 | 5/1958 | Udry | 102/313 X |
| 2,876,843 | 3/1959 | Huber | 102/312 |
| 3,313,234 | 4/1967 | Mohaupt | 102/312 |
| 3,739,723 | 6/1973 | Hakala | 175/4.6 X |
| 4,253,523 | 3/1981 | Ibsen | 166/299 |
| 4,773,299 | 9/1988 | Oestreich et al. | 89/1.15 |
| 4,850,438 | 7/1989 | Regalbuto | 175/4.56 |
| 4,974,515 | 12/1990 | Busch et al. | 102/476 |
| 5,070,786 | 12/1991 | Hartman et al. | 102/214 |
| 5,542,480 | 8/1996 | Owen et al. | 102/310 X |

*Primary Examiner*—Peter A. Nelson
*Attorney, Agent, or Firm*—Alan J. Atkinson

[57] ABSTRACT

A well perforating apparatus for generating a plurality of material perforating jets. A base has a plurality of recesses or apertures, and a liner is proximate to the base and is indented into each recess or aperture. Explosive charges contact the indented surfaces of the liner to form multiple shaped charges. A detonator activates the explosive material to collapse the liner segments proximate to the explosive charges and to generate a plurality of perforating jets. In one embodiment of the invention, the base initially comprises a planar material that can be formed into a geometric shape for insertion into a cylindrical housing or wellbore. The invention substantially reduces manufacturing costs and is especially useful in permitting a high density shot pattern to be generated by the perforating jets.

20 Claims, 2 Drawing Sheets

HIGH DENSITY PERFORATING SYSTEM

BACKGROUND OF THE INVENTION

The present invention relates to the field of shaped charge firing guns for perforating casing and the borehole rock surface in hydrocarbon producing wells. More particularly, the present invention relates to a high density well perforating apparatus.

Well casing is typically installed in a borehole drilled into subsurface geologic formations. The well casing prevents uncontrolled migration of subsurface fluids between different well zones, and provides a conduit for installing production tubing in the well. The well casing also facilitates the running and installation of production tools in the well.

To produce hydrocarbon fluids from a subsurface geologic formation, the well casing is perforated by high velocity jets from perforating gun shaped charges. A firing head in the perforating gun is actuated to detonate a primary explosive and to ignite a booster charge connected to a primer or detonating cord. The detonating cord transmits a detonation wave to each shaped charge. Booster charges within each shaped charge activate explosive material to collapse a shaped charge liner into a shaped charge cavity. The collapsing liner generates a high velocity jet for penetrating the well casing and the adjacent geologic formation. These jets perforate the well casing and establish a flow path for reservoir fluids from the subsurface geologic formations to a well casing interior. In a well having multiple production zones, packers isolate selected zones of the well casing, and production tubing transports the reservoir fluids from each zone to the well surface.

Multiple casing perforations are desirable in certain hydrocarbon producing zones. To form multiple perforations, shaped charges are installed in the perimeter of a perforating gun housing. The individual shaped charges are mechanically positioned in spirals and in other geometric orientations within the perforating gun. These shaped charge geometric orientations create "dead spaces" between adjacent shaped charges which limits the perforation density of the charges and reduces the perforating capability of the gun.

Perforating gun systems typically attach individual shaped charges to a charge carrier. This process requires significant labor and does not easily permit a high concentration of shaped charges in a perforating gun system. To reduce the cost of shaped charge guns, carrier strips sometimes connect shaped charges in a perforating system. However, such charge carrier strips often fragment upon detonation and undesirably increase the debris within the wellbore.

Known perforating guns are expensive and limit the number of shaped charges that can be positioned within a selected wellbore segment. A need therefore exists for an improved perforating gun system that reduces manufacturing cost and that provides a high density shot pattern.

SUMMARY OF THE INVENTION

The present invention provides an apparatus for generating a plurality of material perforating jets. The apparatus comprises a liner having a plurality of indentations which each define a cavity open to a first surface and which define a protruding liner surface extending from an opposing second surface of said liner. An explosive charge proximate to each protruding liner surface combines with the liner indentations to form shaped charges, and a detonator ignites the explosive charge to generate a plurality of material perforating jets.

In other embodiments of the invention, a plurality of apertures are located in a base having an interior and an exterior surface. The base can be substantially planar or can be formable into a geometric shape. A liner proximate to the base exterior surface has an indentation extending into each aperture to define a cavity and to define a protruding liner surface extending from the base interior surface. The base can be formed into a geometric shape insertable within a well, and the cavities can be oriented to control the shot pattern of material perforating jets generated by the explosive material and liner indentations.

DESCRIPTION OF THE PREFERRED EMBODIMENTS

The present invention provides a unique perforating system. The invention is particularly useful in generating a high density shot pattern for perforating a well. The invention is applicable to hydrocarbon producing wells and is equally useful in other applications requiring multiple shaped charges.

Figure 1:
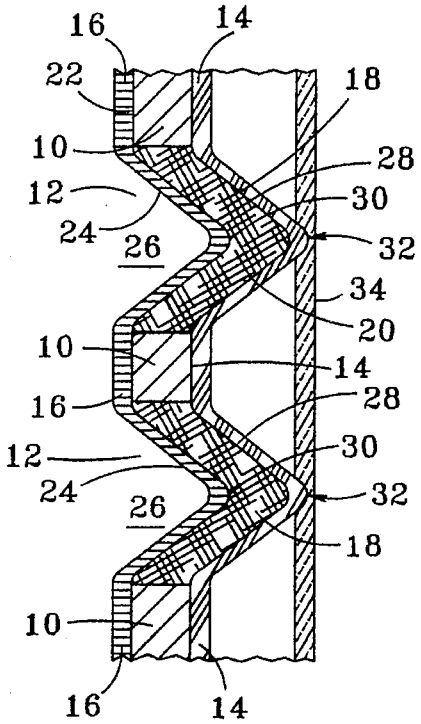
FIG. 1 illustrates a crossectional view of one embodiment of the invention.

FIG. 1 illustrates a crossectional drawing of one embodiment of the invention. Base 10 is illustrated as a substantially planar body having a plurality of apertures 12. As used herein, the term "plurality" is defined as three or more of the referenced element. "Aperture" is defined as a hole or a recess in base 10. As shown in FIG. 1, base 10 has two parallel surfaces identified as interior surface 14 and exterior surface 16. Base 10 can comprise any material such as a metal, ceramic, plastic, or other organic or inorganic material having the requisite physical properties. The selection of the material for base 10 will depend on the desired manufacturing procedures as described more thoroughly below.

Explosive charge 18 is positioned proximate to interior surface 14. Explosive charge 18 is formed with an RDX material or other high explosive material customarily used in the manufacture of shaped explosive charges. In one embodiment of the invention, holder 20 is positioned adjacent to interior surface 14 and retains explosive charge 18 in the desired position relative to interior surface 14. Holder 20 can comprise any material sufficient to retain explosive charge 18, and is preferably bonded to interior surface 14 with adhesives, solder, or other known processes. Although explosive charge 18 can be positioned proximate to interior surface 14, a plurality of explosive charges 18 can each be positioned proximate to corresponding apertures 12 in a preferred embodiment of the invention. For multiple explosive charges 18, a plurality of holders 20 can be positioned to retain each explosive charge 18.

Liner 22, which is metallic or nonmetallic, is proximate to exterior surface 16 and has liner indentations 24 defined as discrete planar segments of liner 22. As shown in FIG. 1, indentations 24 extend into apertures 12 and form cavities 26 and protruding liner surfaces 28. Each cavity 26 is open in a direction corresponding to exterior surface 16, and each protruding liner surface 28 extends from interior surface 14. In a preferred embodiment of the invention, cavity 26 is symmetrically shaped about an axis normal to exterior surface 16. Cavity 26 can be shaped as a cone, parabola, other other shape known in the art. Protruding liner surface 28 contacts explosive charge 18 and can have apex 30 or can be truncated.

Figure 2:
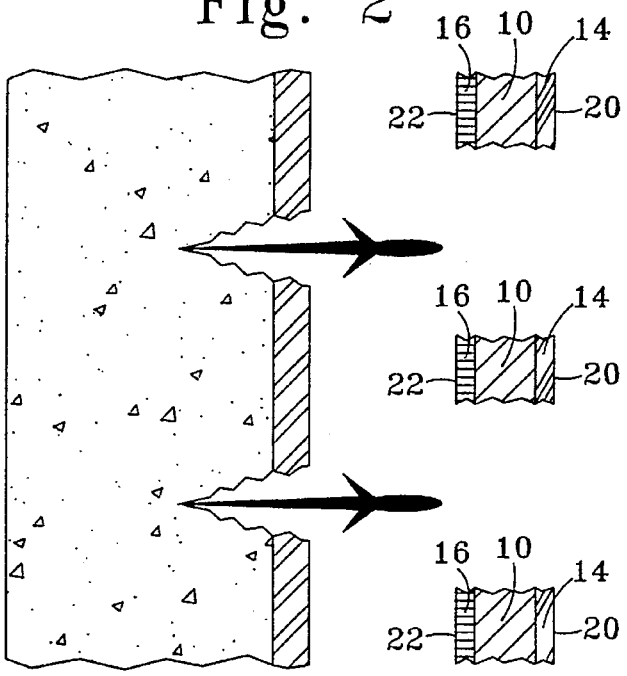
FIG. 2 illustrates a crossectional view of the invention after the detonator activates the explosive charges.

The combination of explosive charge 18 and each indentation 24 forms shaped charges 32 for generating material perforating jets. Detonator 34 comprises a detonator cord or primer material which is placed proximate to explosive charge 18 for the purpose of activating explosive charge 18. Activation of detonator 34 initiates explosive charge 18 to generate a detonation wave for contacting apex 30 and for collapsing liner indentation 24 about cavity 26. As liner indentation 24 collapses, a high speed material perforating jet (not shown) is generated in a direction substantially parallel to the axis through cavity 26. The perforating jet perforates well casing or the geologic formation as shown in FIG. 2.

Figure 3:
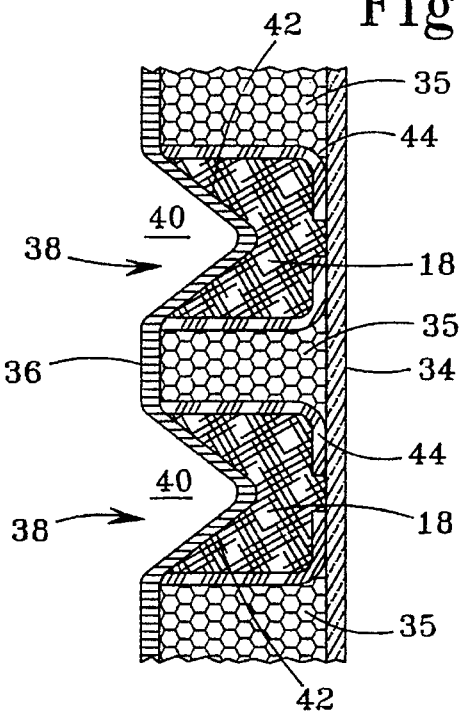
FIG. 3 illustrates an alternative embodiment of the invention.

Although a single explosive charge 18 can initiate shock waves in multiple liner indentations 24, a preferred embodiment uses a separate explosive charge 18 proximate to each protruding liner surface 28 as shown in FIG. 3. This embodiment concentrates the power of explosive charge 18 in an efficient manner and reduces the fragmentation of base 10. Consequently, the amount of unconsolidated debris to be removed from the well after detonation is reduced. Foam 35 can be positioned between multiple explosive charges 18 to reduce charge interference.

FIG. 3 illustrates another embodiment of the invention wherein liner 36 includes liner indentations 38 having cavities 40 and protruding liner surfaces 42. Explosive charges 18 are positioned proximate to protruding liner surfaces 42, and detonator is engaged with explosive charges 18 as previously described. In this embodiment of the invention, liner 36 performs the combined function of base 10 and liner 22 described for the inventive embodiment illustrated in FIG. 1. Liner indentations 38, which can be formed with a different material than the material for the non-indented portions of liner 36, cooperate with explosive charges 18 to form shaped charges 44. The non-indented portion of liner 36 provides an integral base or housing for carrying shaped charges 44. This embodiment of the invention facilitates manufacture because protruding liner surfaces 42 do not require alignment with apertures 12 in base 10 as shown in FIG. 1. In addition, such use of liner 36 eliminates alignment and adhesion procedures between base 10 and liner 22 in FIG. 1.

Figure 4:
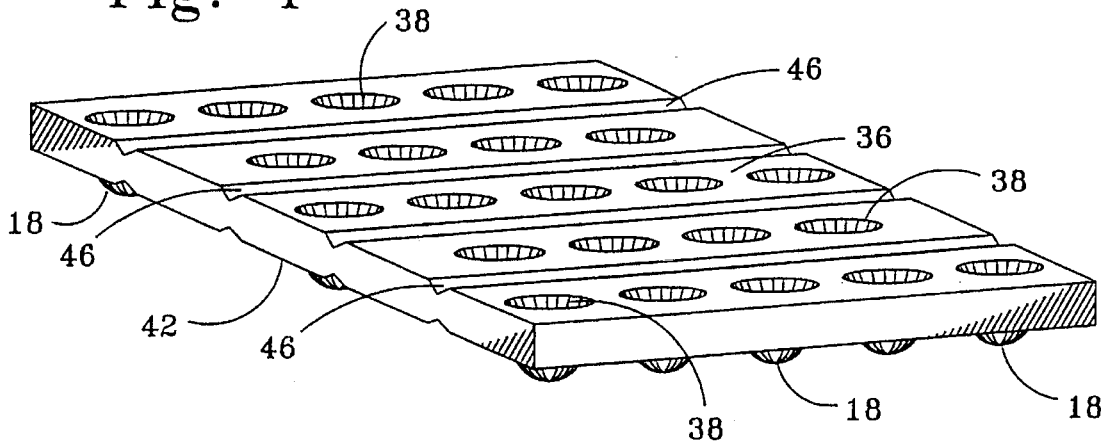
FIG. 4 illustrates a planar base comprising a plurality of shaped charges.

FIG. 4 illustrates a substantially flat liner material 36 having a plurality of liner indentations 38. Liner material 36 can be stamped, rolled or otherwise formed to create indentations 38, and an explosive charge or charges 18 can be positioned adjacent protruding liner surfaces 42. Manufacture of the assembly is simplified by initially combining liner 36 and explosive charges 18 in a planar form.

After the planar combination of liner material 36 and explosive charges 18 is formed, liner material 36 can be scored along marks 46 to form clean breaks in the surface of liner 36. Subsequently, liner 36 can be rolled, folded, fastened, or otherwise shaped to create a desired geometric exterior shape for insertion into a wellbore or other target environment. The final geometric shape for shaped liner 36 can be planar, oval, spherical, hemispherical, cylindrical, or any other desired shape. A single liner 36 can be formed into the desired geometric shape, or multiple liner sections can be connected to form the desired geometric shape.

Figure 5:
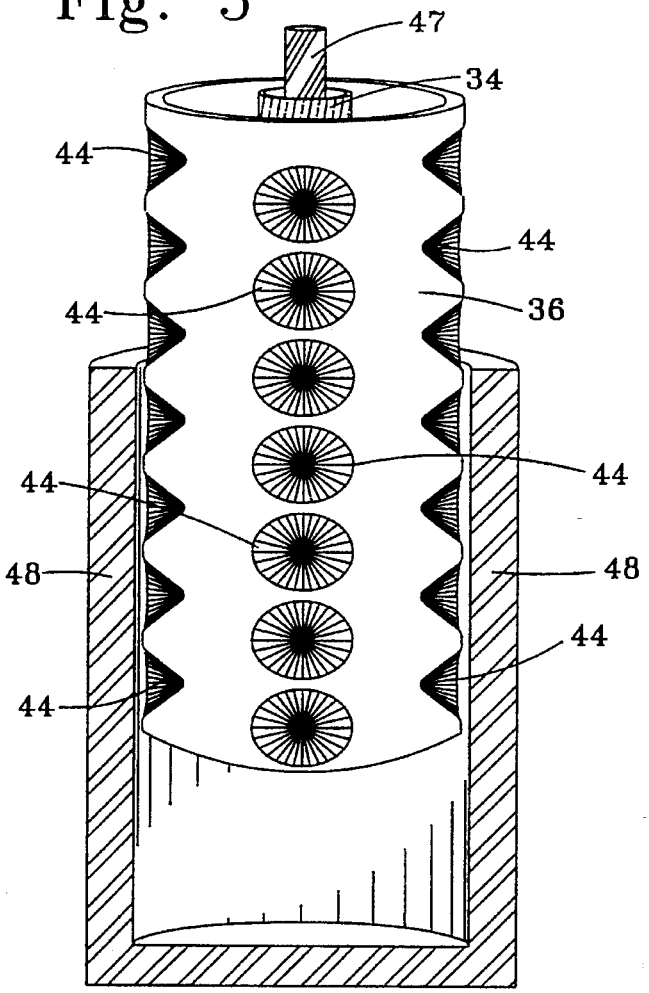
FIG. 5 illustrates a planar base formed into a geometrical shape for insertion within a cylindrical housing.

FIG. 5 illustrates one geometric shape wherein liner 36 is formed in a substantially cylindrical shape suitable for insertion within a well. In this embodiment, detonator 34 can comprise a planar primasheet rolled into a cylinder for contacting explosive material 18. The primasheet can be formed about core material 47 to provide rigidity to the primasheet. Housing 48 can initially contain liner 36 to prevent fluid intrusion therein before shaped charges 44 are detonated. Additionally, housing 48 can be designed to contain debris generated during detonation of explosive charges 18 and can be manually withdrawn from the well with a wireline or other device.

Because the cavities in shaped charges 44 are preferably oriented along an axis normal to the exterior surface liner 36, the geometric shape of liner 36 determines the orientation of the perforating jets generated by shaped charges 44. If desired, such as in low side perforating operations, all of the shaped charges 44 can be oriented in a single direction. Alternatively, and to achieve maximum penetrating density from the perforating jets within a particular well zone, a plurality of shaped charges 44 are oriented in multiple directions.

Figure 6:
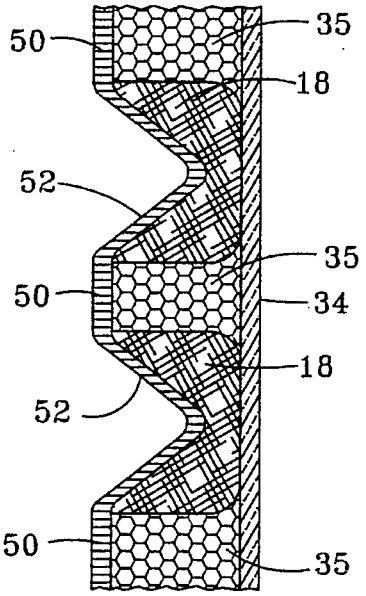
FIG. 6 illustrates a liner having a different material for the shaped charge indentations.

FIG. 6 shows an alternative embodiment of the invention wherein liner surface 50 is attached to indentations 52 in contact with explosive charges 18. Detonator 34 initiates explosive charges 18, and indentations 52 collapse about the respective cavities to form material penetrating jets. In this embodiment of the invention, liner surface 50 can be constructed to resist fragmentation, while indentations 52 can be formed with a material selected for a particular application. Indentations 52 can be press fitted or otherwise adhered to liner surface 50 to form a combined apparatus, and the combination can be shaped into a desired geometrical shape as previously described.

The present invention provides a unique perforating apparatus which significantly reduces manufacturing costs. The invention uniquely permits maximum shot density on the exterior surface area of a perforating gun, and is particularly suited for perforating wells such as hydrocarbon producing wells. The invention provides flexibility in orienting the desired shot pattern and in creating maximum shot density in the desired direction. The size and orientation of the shaped charges is easily formed by modifying the liner indentations and by modifying the size and shape of explosive charges 18.

Although the invention has been described in terms of certain preferred embodiments, it will be apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

What is claimed is:

1. A perforating apparatus for generating a plurality of material perforating jets, comprising:

a liner having a plurality of indentations which each define a cavity open to a first surface of said liner and which each define a protruding liner surface extending from an opposing second surface of said liner;

an explosive charge proximate to each protruding liner surface on the second surface of said liner, wherein said explosive charge and each liner indentation combine to form a shaped charge oriented about the cavity within each liner indentation; and a detonator for igniting said explosive charge to collapse said liner indentations about each corresponding liner cavity to generate a plurality of material perforating jets.

2. An apparatus as recited in claim 1, wherein said liner is substantially planar.

3. An apparatus as recited in claim 1, wherein said liner is formable into a geometric shape for permitting insertion of said liner into a well.

4. An apparatus as recited in claim 1, wherein said explosive charge comprises a plurality of explosive charges each positioned proximate to a protruding liner surface on the second surface of said liner.

5. An apparatus as recited in claim 1, wherein each cavity within a liner indentation is symmetrical about an axis normal to the first surface of said liner.

6. An apparatus as recited in claim 5, wherein said liner is shaped so that said material perforating jets travel in at least two radial directions.

7. An apparatus as recited in claim 1, wherein each indentation is formed with a metallic material having a different composition than the non-indented portions of said liner.

8. An apparatus as recited in claim 1, wherein said detonator comprises a primasheet configured into a cylinder.

9. A perforating apparatus for generating a plurality of material perforating jets in a well, comprising:

a base having an interior surface and an exterior surface;

a plurality of apertures in said base;

a liner proximate to the exterior surface of said base, wherein said liner has a plurality of indentations each extending within one of said apertures to define a cavity shaped about an axis normal to the exterior surface of said base and to define a protruding liner surface extending from the interior surface of said base;

an explosive charge proximate to each protruding liner surface, wherein said explosive charge and each liner indentation combine to form a plurality of shaped charges each symmetric about the corresponding cavity axis; and a detonator for initiating said explosive charge to generate a plurality of material perforating jets from said shaped charges.

10. A well perforating apparatus as recited in claim 9, wherein said liner is substantially planar.

11. A well perforating apparatus as recited in claim 9, wherein the exterior surface of said base and said liner form a geometric shape, and wherein said liner and base are insertable into a cylindrical well.

12. A well perforating apparatus as recited in claim 9, wherein said liner is attached to said base.

13. A well perforating apparatus as recited in claim 9, further comprising a plurality of explosive charges each positioned proximate to a corresponding protruding liner surface.

14. A well perforating apparatus as recited in claim 9, wherein said liner is formed with a metallic material.

15. A well perforating apparatus as recited in claim 9, wherein each liner indentation is formed with a metallic material having a different composition than the non-indented portions of said liner.

16. A perforating apparatus for generating a plurality of material perforating jets downhole in a well, comprising:

a planar base formable into a geometric shape having an exterior surface insertable into the well and an interior surface;

a plurality of apertures in said base;

a metallic liner proximate to the exterior surface of said base, wherein said liner has a plurality of indentations each extending through an aperture so that each indentation forms a cavity open toward the exterior surface of said base and also forms a protruding liner surface adjacent to said base interior surface;

a plurality of explosive charges each proximate to a protruding liner surface of one of said liner indentations, wherein each explosive charge and the corresponding liner indentation combine to form a shaped charge, and wherein said shaped charges are oriented in at least two radial directions; and a detonator for initiating said explosive charges and for generating a plurality of material perforating jets.

17. A perforating apparatus as recited in claim 16, wherein the exterior surface of said base is substantially cylindrical.

18. A perforating apparatus as recited in claim 16, wherein each liner indentation is formed with a metallic material having a different composition than the non-indented portions of said liner.

19. A perforating apparatus as recited in claim 16, wherein the exterior surface of said base is substantially planar, and wherein the interior surface of said base is not planar.

20. A perforating apparatus as recited in claim 16, further comprising a housing around said liner for capturing debris formed within said apparatus as said detonator activates said explosive charges.

* * * * *